United States Patent [19]

Burns et al.

[11] 4,334,360

[45] Jun. 15, 1982

[54] PENCIL MARKING JIG

[76] Inventors: Anthony G. Burns, c/o George Spector 3615 Woolworth Bldg., 233 Broadway; George Spector, 3615 Woolworth Bldg., 233 Broadway, both of, New York, N.Y. 10007

[21] Appl. No.: 149,240

[22] Filed: May 12, 1980

[51] Int. Cl.[3] ..... B43L 13/02

[52] U.S. Cl. ..... 33/42

[58] Field of Search ..... 33/31, 42, 18, 26, 173

[56] References Cited

U.S. PATENT DOCUMENTS

| | | | |
|---|---|---|---|
| 436,166 | 9/1890 | Barrett | 33/31 |
| 992,819 | 5/1911 | Springer | 33/27 C |
| 1,298,866 | 4/1919 | Beach | 33/42 X |
| 2,397,109 | 3/1946 | Hedin | 33/18 R |
| 2,466,357 | 4/1949 | Beith | 33/42 |
| 2,777,199 | 1/1957 | Neiglick | 33/31 X |
| 2,950,535 | 8/1960 | Burgess | 33/26 |

*Primary Examiner*—Harry N. Haroian

[57] ABSTRACT

An attachment for a carpenter's square, the attachment supporting a pencil for marking a straight line along a board, the attachment including a collar inside which the pencil is is adjustably secured, and a clamp integral with the collar for clipping around opposite straight edges of the square calibrated rule, an edge of the clamp aligning with the pencil point so that the clamp edge is used to measure along the scale calibrations.

1 Claim, 3 Drawing Figures

PENCIL MARKING JIG

This invention relates generally to carpenter's tools.

It is well known that a carpenter's pencil is part of a carpenter's tools so as to mark off lines upon lumber where to be cut. When such lines are intended to be parallel to one edge of a board, the carpenter must first measure off several points all equally spaced from the edge and then connect the points by drawing a line therebetween. This takes time to do and can easily be made inaccurate if all points are not precisely a same distance from the edge, so that this is therefore in need of an improvement.

Accordingly it is a principal object of the present invention to provide a pencil marking jig that clamps on a calibrated rule of a square at a selected measurement, so that the square can then be simply slided along an edge of a lumber, and a pencil, carried by the jig, draws a straight line parallel to the lumber edge.

Another object is to provide a pencil marking jig which accordingly saves time and effort, as well as insuring a drawn line to be accurate.

Figure 1:
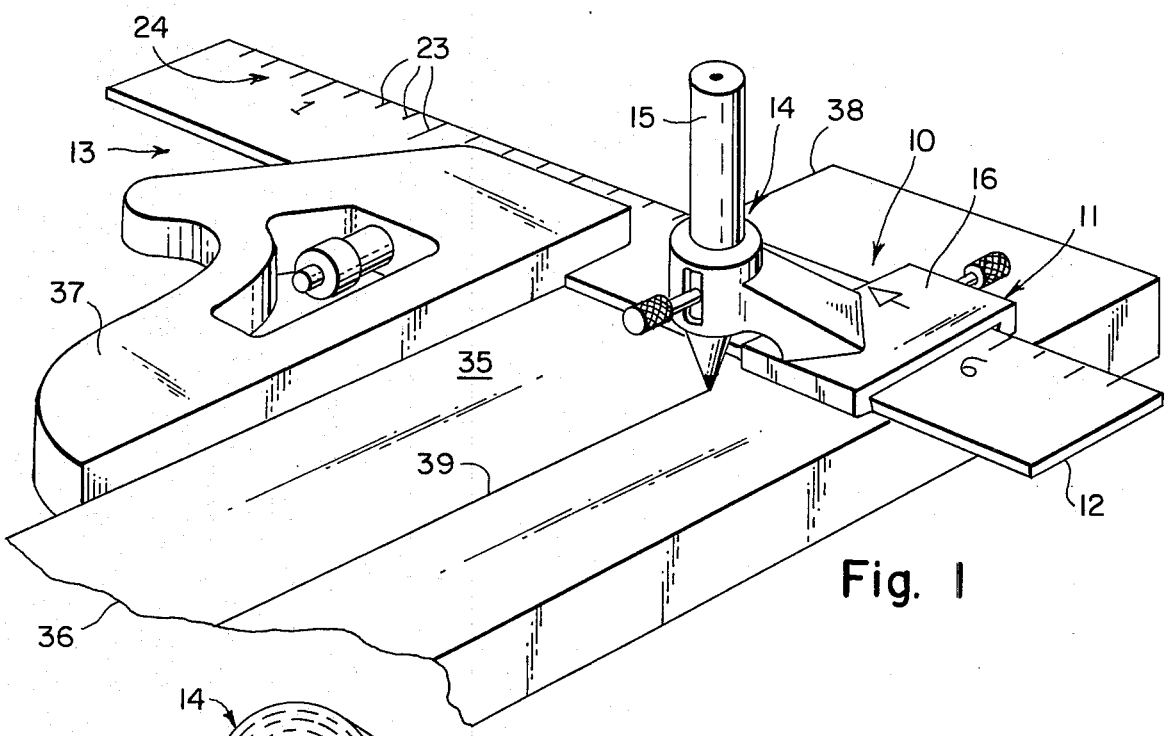
FIG. 1 is a perspective view of the invention shown in use.
Figure 2:
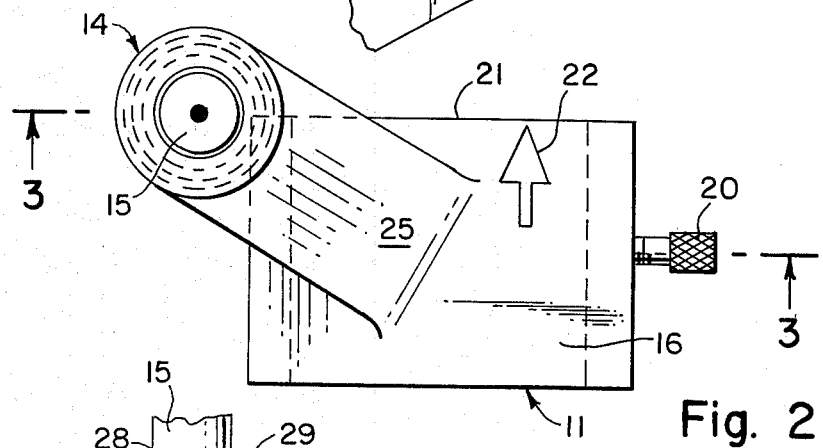
FIG. 2 is a top view of the invention, shown alone.
Figure 3:
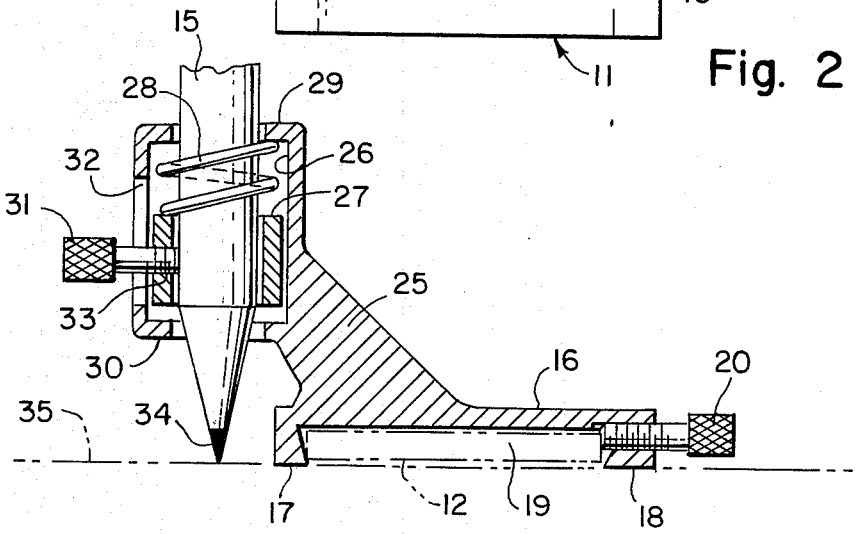
FIG. 3 is a cross sectional view on line 3—3 of FIG. 2.

Referring now to the drawing in greater detail, the reference numeral 10 represents a pencil marking jig, according to the present invention, wherein there is a clamp 11 for adjustably securing to a rule 12 of a carpenter's square 13, the clamp being made integral with a tubular coller 14 inside which a pencil 15 is adjustably secured. The device is made of rigid metal such as a machined steel casing.

The clamp includes a flat plate 16 having a downward foot 17 and 18 along opposite edges so to form a shallow groove 19 therebetween into which the rule fits and is secured by means of a set screw 20 through one foot 18.

The collar extends along a central axis that is perpendicular to the flat plane of the clamp plate, the central axis aligning with an imaginary straight line along one side edge 21 of the clamp that is marked with an arrowhead zz for alignment with selected calibrations 23 of a linear scale 24 engraved along the rule. An angular arm 25 is formed integrally between the clamp and the collar.

The collar has a cylindrical hole 26 therethrough, inside of which a ring 27 is axially slidable against a compression coil spring 28 which at one end bears against an inward flange 29 at one end of the hole. Another inward flange 30 at the opposite end of the hole, prevents the collar to fall out therefrom.

The pencil is inserted through the hole and also through the ring and spring, the pencil being locked therein by a set screw 31 extending through an axial slot 32 of the collar and which is screwed in a threaded opening 33 of the ring so that the screw end locks against the side of the pencil.

In setting the pencil in the collar, it is positioned so that the pencil point 34 contacts a face 35 of a board 36 upon which the feet 17 and 18 rest; and the spring is in a fully compressed condition by means of the ring being slided thereagainst it upwardly.

Then in use, after the clamp is slided alone the rule to the selected calibration of the scale, and locked by the set screw 20, the square handle 37 is abutted along one edge 38 of the board and the square is then slided along the edge, so that the pencil draws a line 39 that is precisely parallel to the edge. As the pencil point wears down in use, the spring pushes the pencil toward the face 35 so that contact is maintained therewith in order that a continuation of the line is drawn. It is to be noted that the pencil being perpendicular to the drawn line results in the line being accurate even after the pencil point is worn down flat, thereby differing from any jig construction wherein a pencil is held in an inclined manner, and which after wearing down of the pencil point, results in a drawn line that is not precisely parallel to the board edge, especially if not spring urged.

What is claimed as new is:

1. A pencil marking jig, comprising in combination, a clamp integral with a collar holding a pencil, said clamp being adjustably locked along a calibrated rule of a carpenter's square, and said collar being positioned along an axis perpendicular to a flat plane of said rule, and aligned with one side edge of said clamp wherein said clamp comprises a flat plate with parallel opposite side edges projecting from said plate for providing a groove therebetween receiving said rule adjustably and a set screw through one said edge for locking said clamp at a desired location, including means biasing said pencil vertically towards said plane wherein said means includes a ring slidable in said collar, a pencil extending vertically through said ring, said collar provided with upper and lower stops at the ends thereof to hold said ring therein, a spring affixed in said collar between said upper stop and said ring to urge said ring and pencil downwardly, an elongated slot in said collar and a set screw extending through said slot and threadably engaging a hole in said ring for locking said ring and pencil together.

* * * * *